United States Patent [19]

Kofahl

[11] 4,373,873

[45] Feb. 15, 1983

[54] HYDROSTATIC AND OIL WELL PUMP

[76] Inventor: William M. Kofahl, Rte. 2, Box 297, Licking, Mo. 65542

[21] Appl. No.: 259,837

[22] Filed: May 4, 1981

[51] Int. Cl.[3] ..... F04B 35/02; F04B 17/00

[52] U.S. Cl. ..... 417/339; 417/343; 92/137

[58] Field of Search ..... 417/343, 338, 339, 341, 417/362; 92/137

[56] References Cited

U.S. PATENT DOCUMENTS

| | | | |
|---|---|---|---|
| 252,350 | 1/1882 | Blasendorff | 417/378 |
| 509,205 | 11/1893 | Deane | 417/343 |
| 889,733 | 6/1908 | Spinolla | 417/378 |
| 1,864,609 | 6/1932 | Musolf | 417/403 |
| 1,885,820 | 11/1932 | Gothard et al. | 417/400 |
| 2,005,995 | 6/1935 | Knox | 417/400 |
| 2,174,114 | 9/1939 | Will | 417/378 |
| 2,664,825 | 1/1954 | Sundstrom | 417/343 |
| 2,702,005 | 2/1955 | Kruse | 417/378 |
| 2,910,948 | 11/1959 | Betzen | 417/338 |
| 3,103,175 | 9/1963 | Humphrey | 417/401 |
| 3,516,762 | 6/1970 | Grable et al. | 417/362 |
| 4,042,311 | 8/1977 | Yonezawa | 417/401 |
| 4,063,825 | 12/1977 | Chardonneau et al. | 417/343 |

*Primary Examiner*—Richard E. Gluck
*Assistant Examiner*—Peter M. Cuomo
*Attorney, Agent, or Firm*—Jerry W. Mills

[57] ABSTRACT

A pump (10) is provided for pumping a fluid (14) from a borehole (12). The pump includes first and second pumping strings (20, 22) extending into the borehole and a return string (50) extending out of the borehole and to a storage tank (18). An upstroke cylinder (34) is slidably mounted for reciprocation on the first pumping string (20) and a downstroke cylinder (38) is slidably mounted for reciprocation on the second pumping string (22). A pump barrel (80) is slidably mounted to the return string (50) and forms a pumping chamber (86). Fluid from the borehole enters the pump chamber (86) through a one-way check valve (84) to equalize the fluid pressures between the pumping chamber and borehole. A pumping fluid is then entered into the first pumping string (20) to urge the upstroke cylinder (34) to the extended position, tensioning a cable (108) to move the pump barrel (80) and downstroke cylinder (38) to the retracted positions pumping the fluid in the pumping chamber up the return string (50). The pumping fluid at the predetermined pressure is then entered into the second pumping string (22) to move the downstroke cylinder (38) to the extended position, moving the upstroke cylinder (34) to the retracted position. Interconnecting lugs (42, 88) on the downstroke cylinder and pump barrel cause the pump barrel to move to the extended position with the downstroke cylinder.

11 Claims, 3 Drawing Figures

HYDROSTATIC AND OIL WELL PUMP

TECHNICAL FIELD

This invention relates to the pumping of fluids, and in particular to the pumping of oil from within a borehole.

BACKGROUND ART

The recovery of oil and other valuable liquids from the ground typically involves the drilling of a borehole from the surface to the depth necessary to contact the oil or fluid reservoir. The drilling device is then removed and a casing having a circular cross section is positioned in the borehole. The casing prevents collapse of the borehole as well as serving other purposes.

A common technique for pumping the oil to the surface from the borehole includes a pumping unit mounted on the surface. Sucker rods extend from the pumping unit to a pump located beneath the oil level in the borehole. The pumping unit reciprocates the sucker rods in the vertical direction which operates the pump to lift the oil to the surface. This technique requires complex equipment which occupies considerable space on the surface. The sucker rods are mechanically interconnected between the pumping unit at the surface and the pump within the borehole which requires the pumping unit to be accurately positioned above the well bore.

Several attempts have been made to simplify and improve the pumping operation. One example of such an attempt is described and illustrated in U.S. Pat. No. 2,702,005 to Kruse, issued Feb. 15, 1955. However, there remains a need for a pump for oil or other fluids having increased reliability and cost effectiveness.

SUMMARY OF THE INVENTION

In accordance with the present invention, a pump for pumping a fluid out of a borehole is provided. The pump includes first and second pumping strings extending into the borehole for carrying a pumping fluid. An upstroke cylinder is slidably mounted on the first pumping string for reciprocating motion between retracted and extended positions. A downstroke cylinder is slidably mounted on the second pumping string for reciprocating motion between retracted and extended positions. A return spring is provided which extends from within the borehole. The return string has upper and lower sections interconnected by a one-way valve structure for permitting fluid flow only from the lower to upper section. A pump barrel is slidably mounted on the return string for reciprocating motion between extended and retracted positions. The pump barrel and lower section of the return string define a pumping chamber of varying volume as the pump barrel is moved between the extended and retracted positions. A second one-way valve structure interconnects the pumping chamber and the borehole so that fluid from the borehole may enter the pumping chamber when the fluid pressure in the borehole exceeds the fluid pressure in the pumping chamber. Connecting structure is secured between the upstroke and downstroke cylinders and engages the return string and pump barrel. As pressurized pumping fluid is entered into the first pumping string, the upstroke cylinder is moved to the extended position, causing the connecting structure to move the downstroke cylinder to the retracted position and move the pump barrel to the retracted position urging fluid within the pumping chamber through the first one-way valve structure into the upper section of the return string. When the pressurized pumping fluid is entered into the second pumping string, the downstroke cylinder moves to the extended position. Lug structure on the downstroke cylinder contacts the lug structure on the pump barrel to move the pump barrel to the extended position.

In accordance with another aspect of the present invention, a pump for pumping fluid out of a borehole is provided which includes first and second pumping strings extending into the borehole with each of the pumping strings having a polish rod at the end thereof within the borehole. An upstroke cylinder is slidably mounted on the polish rod of the first pumping string for reciprocation between retracted and extended positions. A downstroke cylinder is slidably mounted on the polish rod of the second pumping string for reciprocation between retracted and extended positions. The downstroke cylinder has a first lug mounted thereon. A return string extends from the borehole and includes a polish rod at its end within the borehole. The return string includes a lower and upper section interconnected by a one-way check valve permitting fluid to flow only from the lower to the upper section. A pump barrel is slidably mounted on the polish rod on the return string for reciprocating motion between extended and retracted positions, the pump barrel and lower section of the return string defining a pumping chamber therebetween having a varying volume as the pump barrel moves between the retracted and extended positions. The pump barrel includes a second one-way valve for permitting fluid from the borehole to enter the pumping chamber. The pump barrel also includes a second lug mounted thereon. A first sheave is mounted in a fixed relation to the polish rods of the first and second pumping strings and the return string. A second sheave is mounted on the pump barrel. Cable structure interconnects the up and downstroke cylinders and engages the first and second sheaves. The introduction of a pressurized pumping fluid into the first pumping string moves the upstroke cylinder to the extended position, the cable structure moving the downstroke cylinder to the retracted position and moving the pump barrel to the retracted position to pump the fluid therein through the first one-way valve into the upper section of the return string. When pumping fluid is entered into the second pumping string, the downstroke cylinder is moved to the extended position, the first and second lugs being engaged to move the pump barrel to the extended position and moving the upstroke cylinder to the retracted position.

BRIEF DESCRIPTION OF THE DRAWINGS

A more complete understanding of the invention and its advantages will be apparent from the following Detailed Description taken in conjunction with the accompanying Drawings in which.

DETAILED DESCRIPTION

Figure 1:
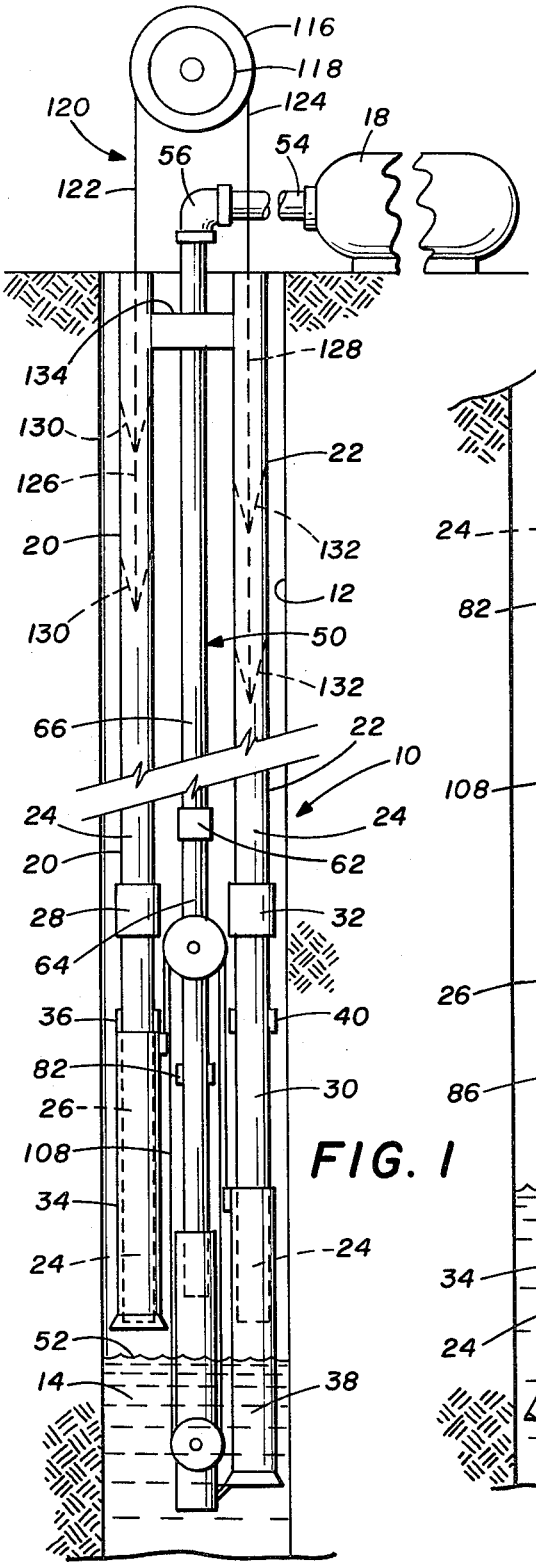
FIG. 1 is a vertical side view of a pump and pressurizing unit forming one embodiment of the present invention.

Referring now to the Drawings, wherein like reference numerals designate like or corresponding parts throughout the several views, there is shown a pump 10 forming an embodiment of the present invention positioned within a borehole 12. The pump 10 is designed to lift fluid 14 to a height above the ground for storage in a storage tank 18. Oil will comprise fluid 14 in the expected predominant use of pump 10. However, it will be understood that pump 10 may be employed to lift any fluid from one elevation to another.

The pump 10 includes a first pumping string 20 and a second pumping string 22 extending from the surface into the borehole. The pumping strings carry the pumping fluid 24 in a column extending from the surface to the end of the pumping strings within the borehole. The pumping fluid 24 may comprise the same fluid as fluid 14 or may comprise any fluid which performs the pumping function discussed hereinafter, including water. A polish rod 26 forms the lower end of the first pumping string 20 and is connected to the remainder of the string by a coupling 28. A polish rod 30 forms the lower end of the second pumping string 22 and is connected to the remainder of the string by a coupling 32.

Figure 2:
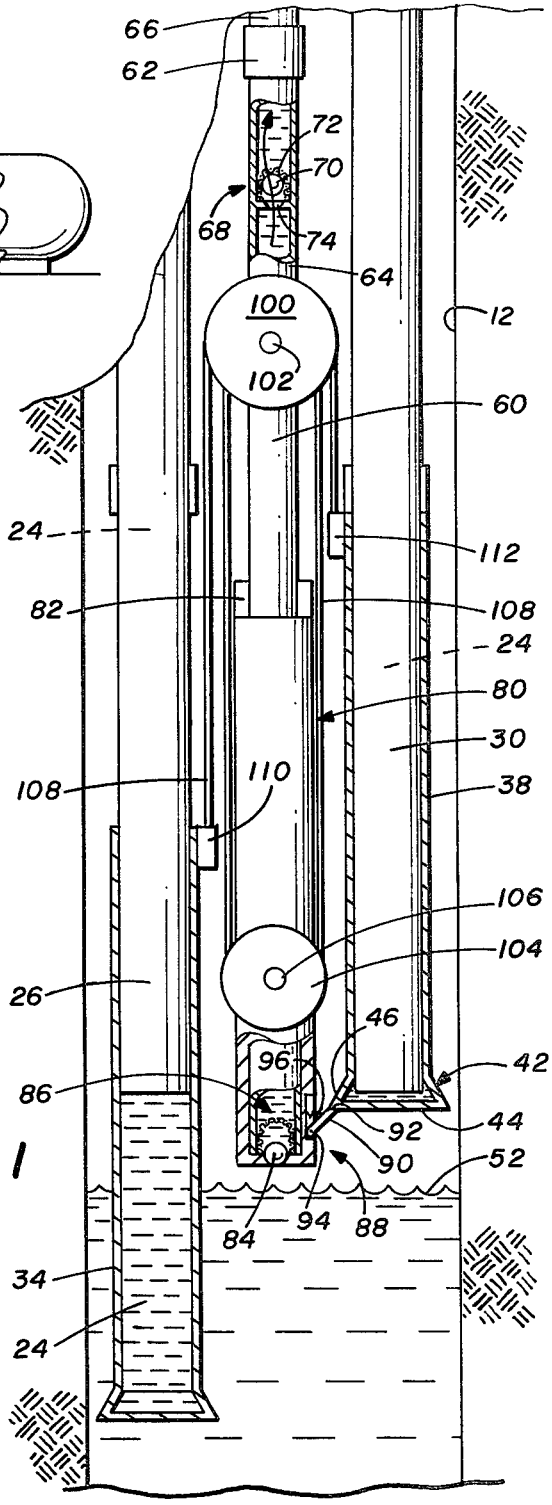
FIG. 2 is a vertical cross-sectional view of the pump mounted in a borehole with the upstroke cylinder in the extended position and the pump barrel in the retracted position having pumped the fluid within the pumping chamber upward in the return string.
Figure 3:
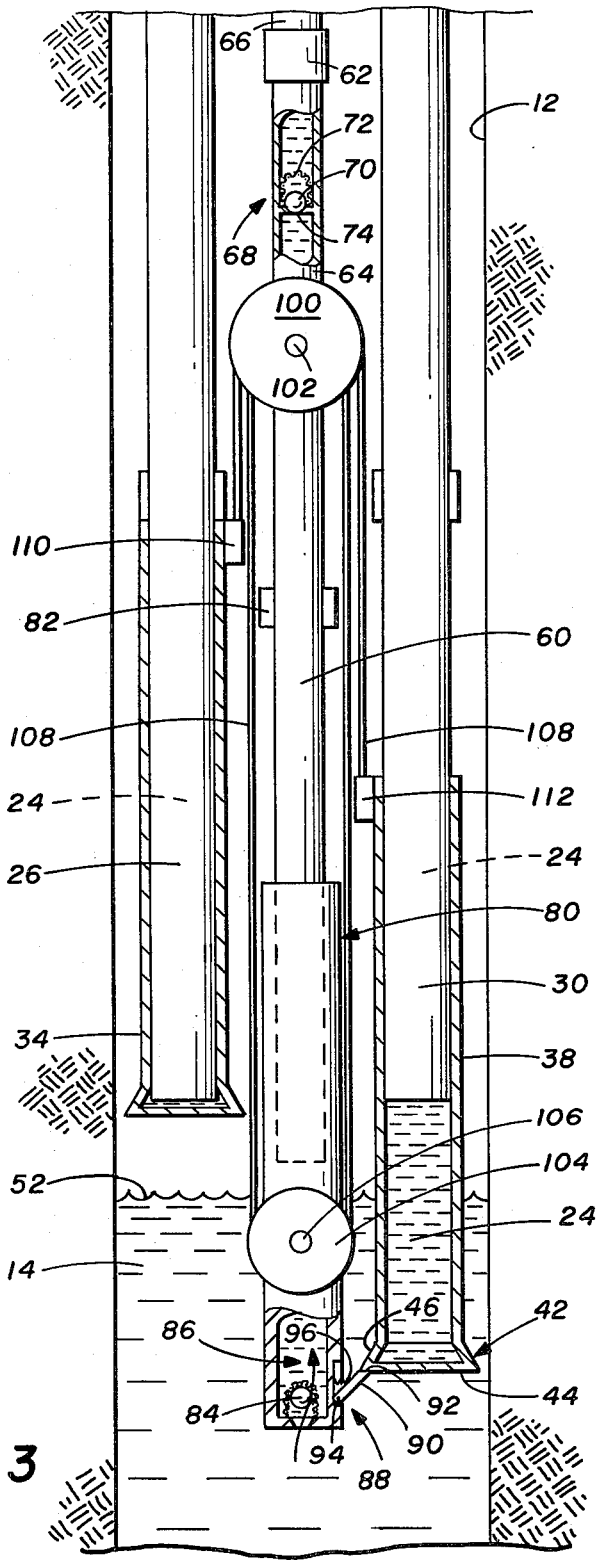
FIG. 3 is a vertical cross-sectional view of the pump positioned in a borehole with the upstroke cylinder in the retracted position permitting fluid from the borehole to enter the pumping chamber.

An upstroke cylinder 34 is slidably mounted on polish rod 26 for reciprocal motion between a retracted position shown in FIGS. 1 and 3 and an extended position shown in FIG. 2. In the retracted position, the upstroke cylinder 34 abuts stop 36. Suitable seals are positioned between the polish rod 26 and upstroke cylinder 34 so that the pumping fluid 24 is confined within the first pumping string 20 and the interior of upstroke cylinder 34.

A downstroke cylinder 38 is similarly slidably mounted on the polish rod 30 for reciprocating motion between an extended position shown in FIGS. 1 and 3 and a retracted position shown in FIG. 2. In the retracted position, the downstroke cylinder 38 abuts stop 40. Again, suitable seals are provided between the polish rod 30 and downstroke cylinder 38 to prevent loss of the pumping fluid 24. The downstroke cylinder 38 includes a fixed lug 42 mounted adjacent the bottom thereof. The fixed lug includes a horizontal flat surface 44 and an inclined surface 46.

A return string 50 extends from within the borehole adjacent the fluid level 52 of fluid 14 to above the ground level. A storage line 54 is connected to the upper end of the return string 50 above ground level by connector 56. The storage line 54 extends to a storage tank 18 for storing fluid 14 pumped to the surface.

The lower end of return string 50 also ends in a polish rod 60 connected to the remainder of the string by connector 62. The return string 50 is divided into two portions, a lower section 64 and an upper section 66. The sections are interconnected by a one-way valve or standing valve 68. The one-way valve 68 includes a ball 70 confined within cage 72 and movable into a sealing engagement with annular orifice 74. The one-way valve 68 permits fluid 14 to flow only from the lower section 64 to the upper section 66. When the pressure or hydraulic head of fluid 14 in upper section 66 exceeds the pressure in the lower section 64, the one-way valve 68 closes to prevent backflow.

A pump barrel 80 is slidably mounted on polish rod 60 for reciprocation between an extended position as shown in FIGS. 1 and 3 and a retracted position as shown in FIG. 2. In the retracted position, the pump barrel 80 abuts against a stop 82. A one-way valve 84 is mounted in the lower end of the pump barrel 80 to permit fluid 14 in the borehole to flow into the pump chamber 86 when the pressure of fluid 14 in the borehole exceeds the pressure in the pump chamber. The pump chamber 86 is defined between the pump barrel 80 and the lower section 64 of the return string 50. A spring loaded downstroke lug 88 is mounted on the pump barrel 80 in alignment with the fixed lug 42 on downstroke cylinder 38. The downstroke lug 88 includes an inclined surface 90 and a horizontal flat surface 92. The downstroke lug 88 is pivoted to the pump barrel 80 by pin 94 and is urged outwardly by a spring 96. If downstroke cylinder 38 moves upwardly with respect to the pump barrel 80 so that inclined surface 46 contacts inclined surface 90, the lug 88 will be pivoted against the pump barrel to permit the downstroke cylinder to pass without interfering with the motion of the pump barrel. However, if the flat surface 44 of lug 42 lies above the flat surface 92 of lug 88, when the downstroke cylinder 38 moves downwardly with respect to the pump barrel 80, the surfaces will engage to urge the pump barrel 80 downwardly with the downstroke cylinder. The pivoting lug 88 may be useful in positioning pump 10 in the borehole.

A sheave 100 is rotatably secured to lower section 64 of the return string 50 by a sheave bearing 102. The sheave 100 preferably includes two grooves for accepting a cable 108. A sheave 104 is rotatably mounted to the outer portion of pump barrel 80 by a sheave bearing 106. Sheave 104 is preferably of the type having one groove about its outer periphery. As the cable 108 is secured at either end to mounts 110 and 112 on the upstroke and downstroke cylinders. The cable engages the sheaves 100 and 104 as illustrated in FIGS. 1 and 2, being looped about each sheave. The cable 108 may comprise either a wire rope or chain or other flexible connector suitable for the loads encountered in the operation of pump 10.

In operation, pumping fluid 24 is provided alternately to the first and second pumping strings at a predetermined pressure. As pumping fluid 24 is provided to one pumping string at the predetermined pressure, the pressure of the pumping fluid in the other pumping string is relieved. If the pump 10 is positioned as shown in FIGS. 1 and 3, at the initiation of operation, it will be observed that fluid 14 has entered the pumping chamber 86 through check valve 84 so that the fluid level in the pumping chamber coincides with the fluid level 52 in the borehole. The pumping fluid 24 at the predetermined pressure is supplied in the first pumping string 20 to urge the upstroke cylinder 34 to the extended position as shown in FIG. 2. As the upstroke cylinder 34 is moved downwardly, cable 108 is drawn off of sheave 100, tensioning the cable. As cable 108 is drawn from the sheave, the pump barrel 80 and downstroke cylinder 38 are forced upwardly toward the retracted positions. As the pump barrel 80 is moved upwardly to the retracted position, the check valve 84 is closed and the fluid 14 within pumping chamber 86 is pressurized. The fluid in the pumping chamber 86 will flow through check valve 68 when the pressure reaches a sufficient level. The length of cable 108 is designed so that as the upstroke cylinder 34 achieves the extended position, the pump barrel 80 and downstroke cylinder 38 are in the retracted position. It will be apparent that the pumping fluid in string 20 acts to pump the fluid 14 in pumping chamber 86 upward towards the surface through the return string 50.

With the upstroke cylinder 34 in the extended position and the downstroke cylinder 38 and pump barrel 80 in the retracted position, the pressure of pumping fluid 24 is released in first pumping string 20 and pumping fluid 24 at the predetermined pressure is entered into the second pumping string 22. The pumping fluid 24 in string 22 forces the downstroke cylinder 38 downwardly to the extended position. As the downstroke cylinder 38 is urged downwardly, cable 108 is played off of sheave 100 urging upstroke cylinder 34 to the retracted position. At some point in the downward travel of downstroke cylinder 38, the surface 44 of lug 42 will engage surface 92 of lug 88. The downstroke cylinder 38 will then move the pump barrel 80 downwardly to the extended position. When the downstroke cylinder and pump barrel are in the extended position and upstroke cylinder 34 has been returned to the retracted position, the pumping sequence may be repeated by repressurizing the pumping fluid 14 in string 20.

The preferred mechanism for alternately pressurizing and relieving the pumping fluid 24 from the strings 20 and 22 is illustrated in FIG. 1. The mechanism includes a cable drum 116 mounted for rotation above the borehole by a reversible electric motor 118. The cable drum 116 includes a number of grooves in its outer periphery for accepting a swab line 120. Portion 122 of swab line 120 enters string 20 through a sealed orifice. Portion 124 enters the string 22 through a sealed orifice in a similar manner. Both portions 122 and 124 extend to a sinker bar 126 and 128. Swab cups 130 and 132 are mounted at the ends of sinker bars 126 and 128. A conduit 134 interconnects the pumping strings 20 and 22 near the surface. The conduit 34, as well as other support members (not shown) are employed to maintain the pumping strings 20 and 22 and return string 50 in a fixed relationship.

By providing pumping fluid 24 throughout the interior of strings 20 and 22 and connector 134, the alternate pressurization and release necessary to operate pump 10 may be provided by operating electric motor 118 a predetermined number of revolutions in a first direction and reversing the rotation for the same number of revolutions in the opposite direction. This will act to alternately move the swab cups 130 and 132 downwardly in the strings to pressurize the pumping fluid below. The fluid pressure above the swab cups is maintained at a uniform level as fluid can flow between the strings through connector 134. While the mechanism described hereinabove and illustrated in FIG. 1 forms the preferred technique for operating pump 10, it is readily apparent that many other systems may be suitably employed to perform the same function.

It can be seen that pump 10 provides a pumping action to lift the fluid 14 from within a borehole to a surface. The operation of the pump does not require the use of any sucker rods or other aligned rigid structure. While the pumping strings 20 and 22 are illustrated in the accompanying drawings as vertically aligned, the pump 10 will operate as effectively if the strings must be curved, offset or otherwise moved from a linear alignment. This provides great flexibility in the use of pump 10.

While only one embodiment of the present invention has been described in detail herein and shown in the accompanying drawings, it will be evident that various further modifications or substitutions are possible without departing from the scope of the invention.

I claim:

1. A pump for pumping a fluid from a first elevation to a second elevation, comprising:

first and second pumping strings extending adjacent the first elevation for carrying a pumping fluid;

an upstroke cylinder slidably mounted on said first pumping string for reciprocating motion between retracted and extended positions;

a downstroke cylinder slidably mounted on said second pumping string for reciprocating motion between retracted and extended positions;

a return string extending from the first to the second elevations, said return string having an upper and a lower section interconnected by a one-way valve means for permitting fluid to flow only from the lower to the upper section;

a pump barrel slidably mounted on said return string for reciprocating motion between extended and retracted positions, said pump barrel and lower section of said return string defining a pumping chamber therebetween varying in volume as said pump barrel moves between the extended and retracted positions, the fluid at the first elevation being permitted to enter the pumping chamber to equalize the fluid pressure therebetween; and cable means secured between said upstroke and downstroke cylinders, and said pump barrel and engaging sheave means supported in a fixed relation to said return string, the entry of pumping fluid into said first pumping string at a predetermined pressure urging said upstroke cylinder to the extended position and tensioning said cable means to urge said downstroke cylinder and said pump barrel to the retracted positions, pumping the fluid in the pumping chamber into the upper section of said return string, the entry of pumping fluid at the predetermined pressure into said second pumping string urging said downstroke cylinder to the extended position and tensioning said cable means to urge said upstroke cylinder to the retracted position, said downstroke cylinder and pump barrel having cooperating lug means so that said pump barrel is urged to the extended position by said downstroke cylinder.

2. The pump of claim 1 wherein said pump barrel includes a check valve for permitting flow of fluid at the first elevation into the pumping chamber.

3. The pump of claim 1 wherein said pump barrel has a sheave rotatably mounted thereon, said cable means engaging said sheave.

4. The pump of claim 1 wherein said sheave means supported in a fixed relation to said return string comprises a sheave rotatably mounted to said return string having at least one groove in its periphery to engage said cable means.

5. The pump of claim 1 wherein said lug means comprises a first lug and a second lug, each being mounted to either said pump barrel or said downstroke cylinder, said first lug and second lug engaging as said downstroke cylinder moves to the extended position so that said pump barrel is simultaneously moved to the extended position.

6. The pump of claim 1 wherein each of said first and second pumping strings is sealed, said pump further comprising:

connector means for permitting flow between said first and second pumping strings;

first pumping string swab cup means positioned for slidable motion within said first pumping string and in sealing engagement therewith to define lower and upper sections in said first pumping string and preventing flow of pumping fluid between the upper and lower sections;

second pumping string swab cup means positioned for slidable motion within said second pumping string and in sealing engagement therewith to define upper and lower sections in said second pumping string and preventing pumping fluid from flowing therebetween;

swab line means for interconnecting said first and second pumping string swab cup means for joint motion, said connector means interconnecting the upper sections of each of said first and second pumping strings, said swab line means maintaining the combined volume of the upper sections of said first and second pumping strings substantially uniform; and means for oscillating said swab line means to move said first and second pumping string swab cup means to alternately pressurize the pumping fluid in the lower section of each of said first and second pumping strings to the predetermined pressure while simultaneously relieving the pumping fluid pressure in the other pumping string.

7. A pump for pumping a fluid out of a borehole, comprising:

first and second pumping strings extending into a borehole, each of said pumping strings having a polish rod at the end thereof within the borehole;

an upstroke cylinder slidably mounted on the polish rod of said first pumping string for reciprocating between retracted and extended positions;

a downstroke cylinder slidably mounted on the polish rod of said second pumping string for reciprocating between retracted and extended positions, said downstroke cylinder having a first lug mounted thereon;

a return string extending from said borehole, said return string having lower and upper sections interconnected by a check valve to permit flow of fluid only from the lower to the upper section, said return string having a polish rod at the end thereof within the borehole;

a pump barrel slidably mounted on the polish rod of said return string for reciprocating between extended and retracted positions, said pump barrel in the lower section of said return string defining a pumping chamber varying in volume as said pump barrel moves between the extended and retracted positions, said pump barrel further having a check valve communicating between the fluid in the borehole and the pumping chamber to permit flow of the fluid into the pumping chamber, said pump having a second lug mounted thereon;

a first sheave mounted in a fixed relation to said return string;

a second sheave mounted on said pump barrel; and cable means secured between said upstroke and downstroke cylinders and engaging said first and second sheaves so that as pumping fluid at a predetermined pressure is entered into said first pumping string, said upstroke cylinder moves to the extended position, tensioning said cable means to urge said pump barrel and downstroke cylinder to their retracted positions, the fluid within the pumping chamber being pumped through said check valve interconnecting the upper and lower sections of said return string, said first and second lugs cooperating to permit said downstroke cylinder to move to the retracted position independent of said pump barrel, said downstroke cylinder being urged to the extended position as pumping fluid at the predetermined pressure is entered into said second pumping string, said cable means being tensioned to urge said upstroke cylinder to the retracted position, said first and second lugs engaging so that said downstroke cylinder and said pump barrel are jointly urged to the extended positions.

8. The pump of claim 7 wherein one of said first and second lugs is pivotally mounted to pivot out of engagement with the other lug.

9. The pump of claim 7 wherein each of said first and second pumping strings includes a sealed interior carrying said pumping fluid, said pump further comprising:

connector means interconnecting the interiors of said first and second pumping strings to permit pumping fluid flow therebetween;

at least one first swab cup positioned for slidable motion in the interior of said first pumping string and preventing flow of pumping fluid thereby to separate said first pumping string into upper and lower sections;

at least one second swab cup positioned for slidable motion in the interior of said second pumping string and preventing flow of pumping fluid thereby to separate said second pumping string into upper and lower sections said connector means interconnecting the upper sections of said first and second pumping strings;

a swab line interconnecting the first and second swab cups so that the combined volume of the upper sections of said first and second pumping strings is maintained substantially uniform; and means for reciprocating said swab line to move said first and second swab cups within said first and second pumping strings to alternately pressurize the pumping fluid in the lower section of each of said first and second pumping strings to the predetermined pressure while simultaneously releasing the pressure in the other pumping string.

10. A pump for pumping a fluid out of a borehole, comprising:

first and second pumping strings extending into the borehole, each of said pumping strings having a polish rod at the end within the borehole;

an upstroke cylinder slidably mounted on the polish rod of said first pumping string for reciprocating between retracted and extended positions, said first pumping string having a stop secured thereto abutting said upstroke cylinder in the retracted position;

a downstroke cylinder slidably mounted to the polish rod of said second pumping string for reciprocating between retracted and extended positions, said second pumping string having a stop secured thereon abutting said downstroke cylinder in the retracted position, said downstroke cylinder having a first lug mounted thereon;

a return string extending from said borehole and having a polish rod at the end within the borehole, said return string having a lower and upper section interconnected by a one-way check valve to permit fluid flow only from the lower section to the upper section, the polish rods of each of said first and second pumping strings and said return string being aligned parallel within the borehole;

a pump barrel slidably mounted on the polish rod of said return string for reciprocating motion between retracted and extended positions, said return string having a stop secured thereon abutting said pump barrel in the retracted position, said pump barrel and the lower section of said return string defining a pumping chamber varying in volume as said pump barrel is moved between the retracted and extended positions, said pump barrel having a one-way check valve mounted therein permitting fluid in the borehole to enter the pumping chamber, said pump barrel having a second lug mounted thereon;

a first sheave rotatably mounted to said return string;

a second sheave rotatably mounted to said pump barrel;

cable means secured at its ends to said downstroke and upstroke cylinders and engaging said first and second sheaves; and the introduction of pumping fluid at a predetermined pressure in said first pumping string urging said upstroke cylinder to the extended position, tensioning said cable means to urge said pump barrel and downstroke cylinder into the retracted position pumping the fluid within the pumping chamber through the one-way check valve in said return string, the entry of pumping fluid at the predetermined pressure in said second pumping string while simultaneously relieving the pressure in said first pumping string urging said downstroke cylinder to the extended position, said first and second lugs cooperating so that said pump barrel is urged to the extended position simultaneously, said downstroke cylinder tensioning said cable means to urge said upstroke cylinder into the retracted position.

11. The pump of claim 10 wherein each of said first and second pumping strings includes a sealed interior containing pumping fluid, said pump further comprising:

a connector interconnecting the interior of each of said pumping strings to permit pumping fluid to flow therebetween;

at least one swab cup positioned for slidable motion within the interior of said first pumping string and preventing flow of the pumping fluid thereby to define upper and lower sections in said first pumping string;

at least one second swab cup positioned for slidable motion within the interior of said second pumping string and preventing flow of the pumping fluid thereby to define upper and lower sections in said second pumping string, said connector interconnecting said first and second pumping strings between the upper sections thereof;

a swab line interconnecting said first and second swab cups to maintain the combined volume of the upper sections of said pumping string substantially uniform; and motor means for reciprocating said swab line so that the lower sections of said of said pumping strings are alternately pressurized to the predetermined pressure while the pressure in the other pumping string is relieved.

* * * * *